US006893334B1

(12) United States Patent
Stivers

(10) Patent No.: US 6,893,334 B1
(45) Date of Patent: May 17, 2005

(54) ROTATING GUARD FOR ANGLE GRINDER

(76) Inventor: J. David Stivers, 275 Powers La., Corbin, KY (US) 40701

( * ) Notice: Subject to any disclaimer, the term of this patent is extended or adjusted under 35 U.S.C. 154(b) by 0 days.

(21) Appl. No.: 10/350,987

(22) Filed: Jan. 24, 2003

Related U.S. Application Data

(60) Provisional application No. 60/352,109, filed on Jan. 24, 2002.

(51) Int. Cl.[7] ..... B24B 27/08

(52) U.S. Cl. ..... 451/359; 451/354; 451/452; 451/457

(58) Field of Search ..... 30/382, 390, 391; 451/344, 354, 355, 356, 357, 358, 359, 451, 451/452, 457

(56) References Cited

U.S. PATENT DOCUMENTS

| | | | | |
|---|---|---|---|---|
| 1,811,577 | A * | 6/1931 | Crowe | 30/391 |
| 2,366,017 | A * | 12/1944 | Fortune | 30/370 |
| 2,876,810 | A | 3/1959 | Peterson et al. | |
| 3,034,493 | A * | 5/1962 | Bandy | 125/13.01 |
| 3,382,578 | A | 5/1968 | Dobbertin | |
| 3,585,980 | A * | 6/1971 | Mellor | 125/13.01 |
| 3,787,973 | A | 1/1974 | Beisch et al. | |
| 3,969,856 | A | 7/1976 | Zerrer | |
| 4,022,182 | A * | 5/1977 | Lenkevich | 125/13.01 |
| 4,799,416 | A | 1/1989 | Kumasaka et al. | |
| 4,848,001 | A | 7/1989 | Clark et al. | |
| 5,042,348 | A | 8/1991 | Brundage et al. | |
| 5,199,343 | A | 4/1993 | O'Banion | |
| 5,384,985 | A | 1/1995 | Jacobsson | |
| 5,440,815 | A | 8/1995 | Inkster | |
| 5,766,062 | A | 6/1998 | Edling | |
| 5,918,521 | A | 7/1999 | Sartori et al. | |
| 5,940,976 | A | 8/1999 | Soderqvist et al. | |
| 5,974,674 | A * | 11/1999 | Kelly | 30/391 |
| 6,375,557 | B1 * | 4/2002 | Spangenberg et al. | 451/344 |

* cited by examiner

*Primary Examiner*—Timothy V. Eley
(74) *Attorney, Agent, or Firm*—Stites & Harbison, PLLC; David W. Nagle, Jr.; Mandy V. Wilson

(57) ABSTRACT

A guard for a rotary cutting tool allows for automatic adjustment of the guard relative to the cutting disc and to a workpiece. Such an automatic adjustment allows a user to cut around substantially the entire circumference of a rounded workpiece, such as a pipe, without requiring alteration of the angle at which the tool is held, repositioning by the user, or repositioning or removal of the guard. The guard includes a bracket for mounting the guard to the rotary cutting tool, a hood mounted to the bracket and enclosing a portion of the cutting disc, and a spring for biasing one end of the hood into substantially continuous contact with the workpiece during operation of the rotary cutting tool.

7 Claims, 5 Drawing Sheets

ROTATING GUARD FOR ANGLE GRINDER

CROSS REFERENCE TO RELATED APPLICATION

This application claims priority to U.S. Provisional Application Ser. No. 60/352,109 filed Jan. 24, 2002 and relates to a guard for a rotary cutting tool. The entire disclosure contained in U.S. Provisional Application Ser. No. 60/352,109 is incorporated herein by this reference.

FIELD OF THE INVENTION

This invention relates generally to the field of guards for power tools. In particular, the present invention relates to a guard for a rotary cutting tool, such as an angle grinder, which allows for automatic adjustment of the guard relative to a workpiece. Such an automatic adjustment allows a user to cut around substantially the entire circumference of a rounded workpiece, such as a pipe, without requiring alteration of the angle at which the tool is held, repositioning by the user, or repositioning or removal of the guard.

BACKGROUND OF THE INVENTION

Various types of guards for rotary cutting tools, such as angle grinder, are disclosed in the prior art. These guards typically cover a portion of the cutting blade or disc of the tool, thereby protecting the user from accidentally contacting the blade or disc of the cutting tool with any part of the body, such as the hands. Such guards further reduce the likelihood that flying debris created during the cutting process will be flung directly back into the user's face or eyes.

When cutting workpieces having a 360° circumference, such as pipes, it is common to use tools such as angle grinders, which are capable of cutting through metal, PVC, and other materials commonly used for constructing pipe. To cut through the entire circumference of a pipe, it is necessary to access the entire exterior surface of the pipe. However, guards currently in use for rotary cutting tools, such as angle grinders, are often fixed in place relative to the cutting blade or disc, or at best can be manually adjusted along a limited range of travel. Accordingly, the user must alter the angle at which the cutting tool is held or move to the opposite side of the pipe being cut. If the opposite side of the pipe is not accessible, the user is forced to stop and adjust the positioning of the guard relative to the cutting blade or disc to complete the cutting process. Often, the user's solution is to remove the guard, thereby increasing the risk of injury.

It is therefore a paramount object of the present invention to provide a guard for a rotary cutting tool which allows for automatic adjustment of the guard relative to a workpiece.

It is a further object of the present invention to provide a guard that allows a user to cut, grind, or brush around substantially the entire circumference of a round workpiece, such as a pipe, without requiring alteration of the angle at which the tool is held, repositioning by the user, or repositioning or removal of the guard.

These and other objects and advantages of the present invention will become apparent upon a reading of the following description along with the appended drawings.

SUMMARY OF THE INVENTION

The present invention is a guard for a rotary cutting tool, such as an angle grinder, which allows for automatic adjustment of the guard relative to the cutting disc and to a workpiece. Such an automatic adjustment allows a user to cut around substantially the entire circumference of a rounded workpiece, such as a pipe, without requiring alteration of the angle at which the tool is held, repositioning by the user, or repositioning or removal of the guard. The guard of the present invention is designed to be used with a rotary cutting tool that is adapted to accept any number of implements, including for example, a cutting disc, a grinder, or a wheel brush. For purposes of simplifying the description and claims that follow, such an implement for the cutting tool is referred to as a "cutting disc."

A preferred guard made in accordance with the present invention includes a hood for enclosing a portion of a cutting disc. Secured to and extending from the upper surface of the hood is an annular engaging collar. The preferred guard further includes a bracket through which apertures are defined to allow for mounting the guard to the cutting tool though the use of bolts or similar common fasteners.

The preferred guard further includes a bearing sleeve mounted to a lower surface of the bracket and extending downwardly therefrom, and a collar mounted to and adapted for rotation with respect to the bearing sleeve. The rotating collar is then mated with the engaging collar that is secured to the upper surface of the hood. Thus, since the engaging collar and hood are secured to the rotating collar, the engaging collar and hood rotate with the rotating collar relative to the bearing sleeve.

The preferred guard further includes a spring for biasing a first end of the hood into substantially continuous contact with a workpiece during a cutting operation. Specifically, the biasing spring preferably has a first end that is secured to the bracket or an arm extending therefrom, and a second end that is secured to the hood.

It is further preferred that the guard include at least one guide mechanism mounted near the first end of the hood. Specifically, in this preferred embodiment, the guide mechanism comprises: a guide arm affixed to the first end of the hood and a guide wheel rotatably mounted to a distal end of the guide arm. In practice, because of the biasing of the first end of the hood, it is the guide wheel that maintains substantially continuous contact with the workpiece. Because of the ability of the guide wheel to rotate, there is reduced frictional contact between the guard and the workpiece.

When using the assembled guard and cutting tool, the cutting disc is placed into contact with the workpiece, which is cut while a predetermined reference line, corresponding to the desired cut to be made, is traced with the guide wheel. As the cutting tool progresses along the outer surface of the workpiece, regardless of the angle of the surface being cut or the angle at which the cutting tool is held while cutting the workpiece, the biasing spring continually urges the hood and guide wheel affixed thereto into substantially continuous contact with the workpiece. The contact of the hood with the surface of the workpiece thus causes the hood to rotate relative to the bearing sleeve. As a result, the position of the hood relative to the cutting disc is automatically adjusted so as to continuously protect the user from accidentally contacting the disc.

As a further refinement, the preferred guard also includes a handle assembly that is attached to the bracket to improve a user's grip on the cutting tool.

As yet another refinement, the preferred guard may also include a locking device that allows the user to temporarily disable the ability of the hood to rotate.

DETAILED DESCRIPTION OF THE INVENTION

The present invention is a guard for a rotary cutting tool, such as an angle grinder, which allows for automatic adjustment of the guard relative to the cutting disc and to a workpiece. Such an automatic adjustment allows a user to cut around substantially the entire circumference of a rounded workpiece, such as a pipe, without requiring alteration of the angle at which the tool is held, repositioning by the user, or repositioning or removal of the guard. The guard of the present invention is designed to be used with a rotary cutting tool that is adapted to accept any number of implements, including for example, a cutting disc, a grinder, or a wheel brush. As mentioned above, for purposes of simplifying the description and claims that follow, such an implement for the cutting tool is referred to as a "cutting disc."

Figure 1:
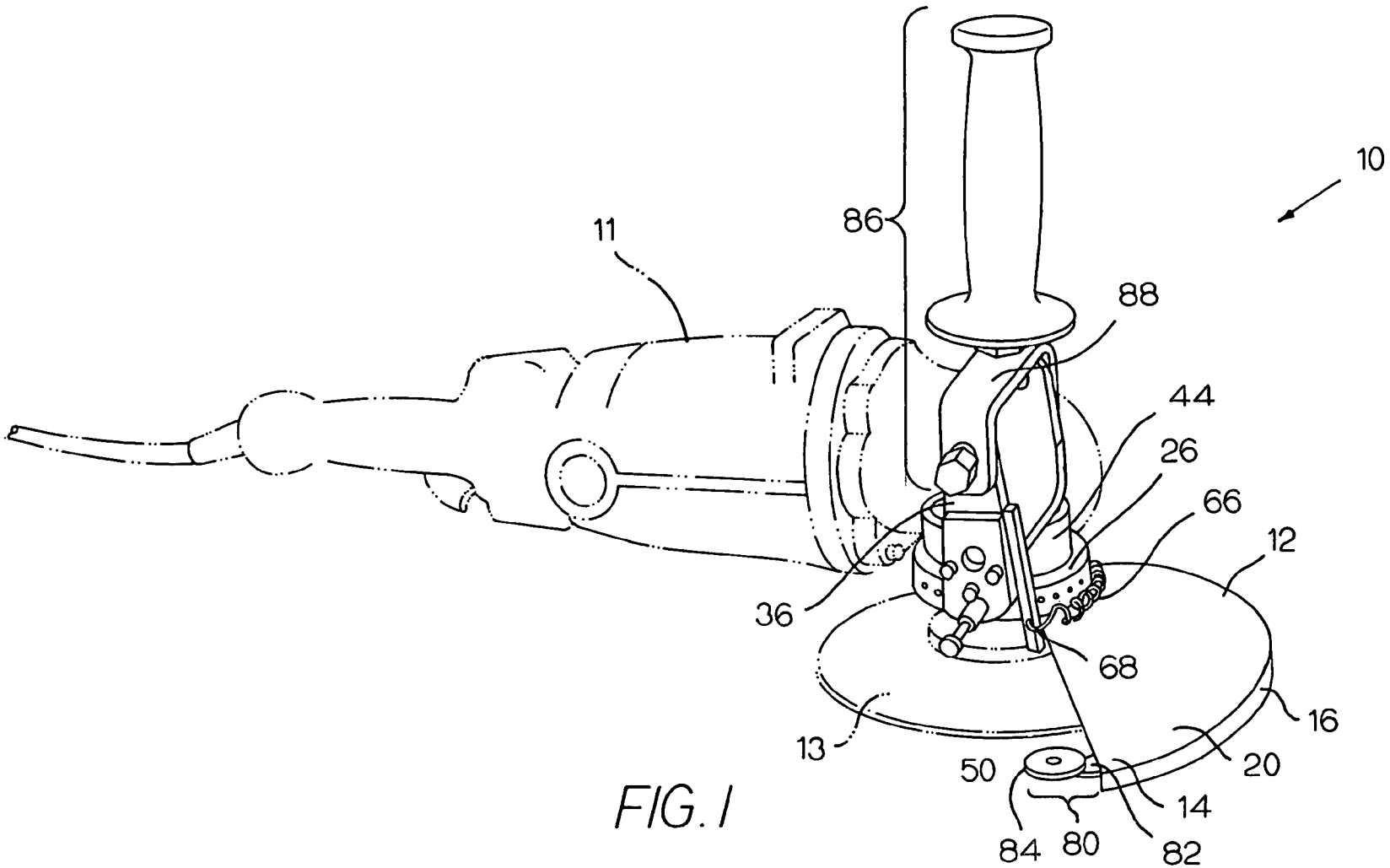
FIG. 1 is a perspective view of a preferred guard made in accordance with the present invention and mounted onto the body of a rotary cutting tool, which is illustrated in phantom.
Figure 2:
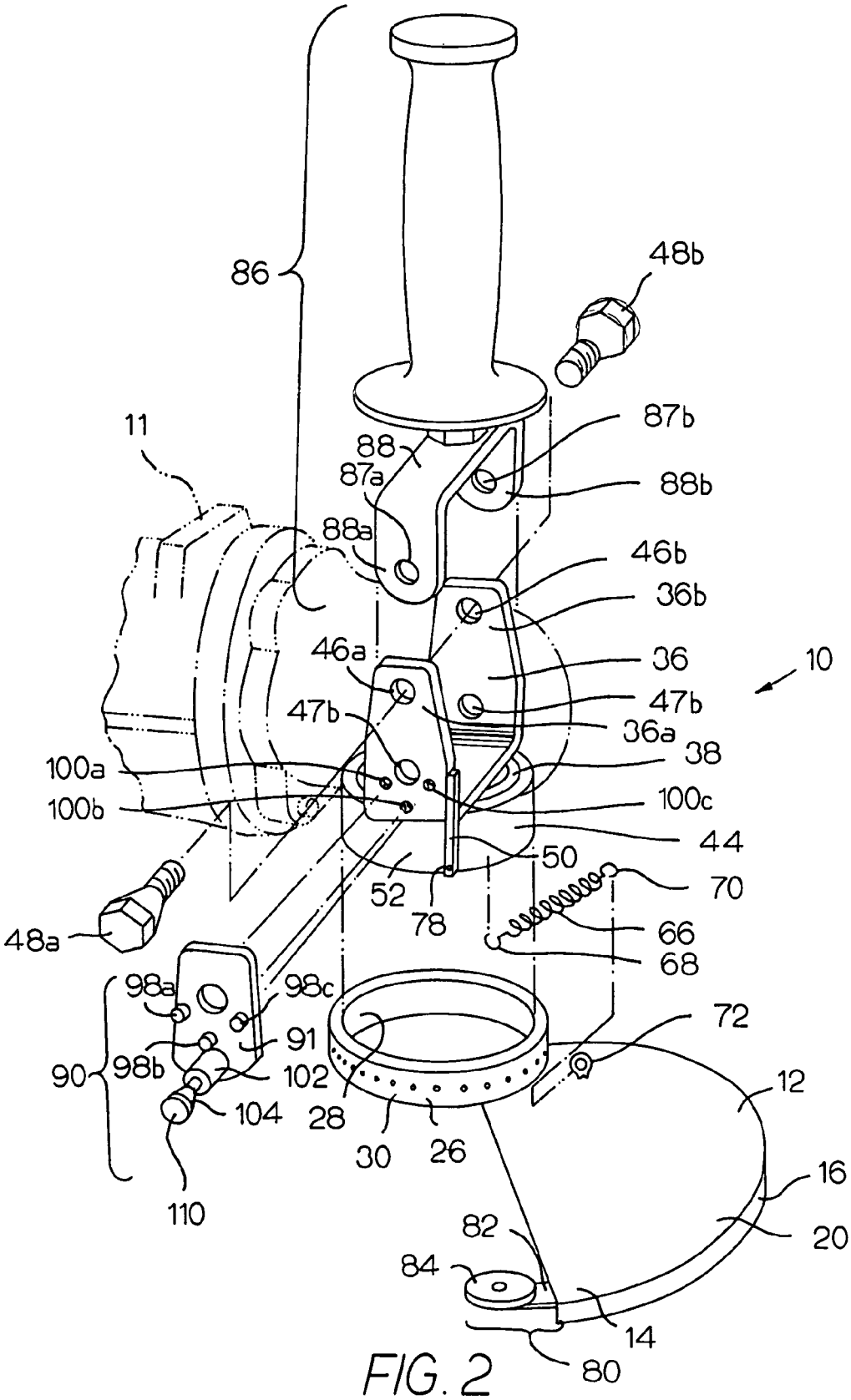
FIG. 2 is an exploded perspective view of the preferred guard of FIG. 1.
Figure 3:
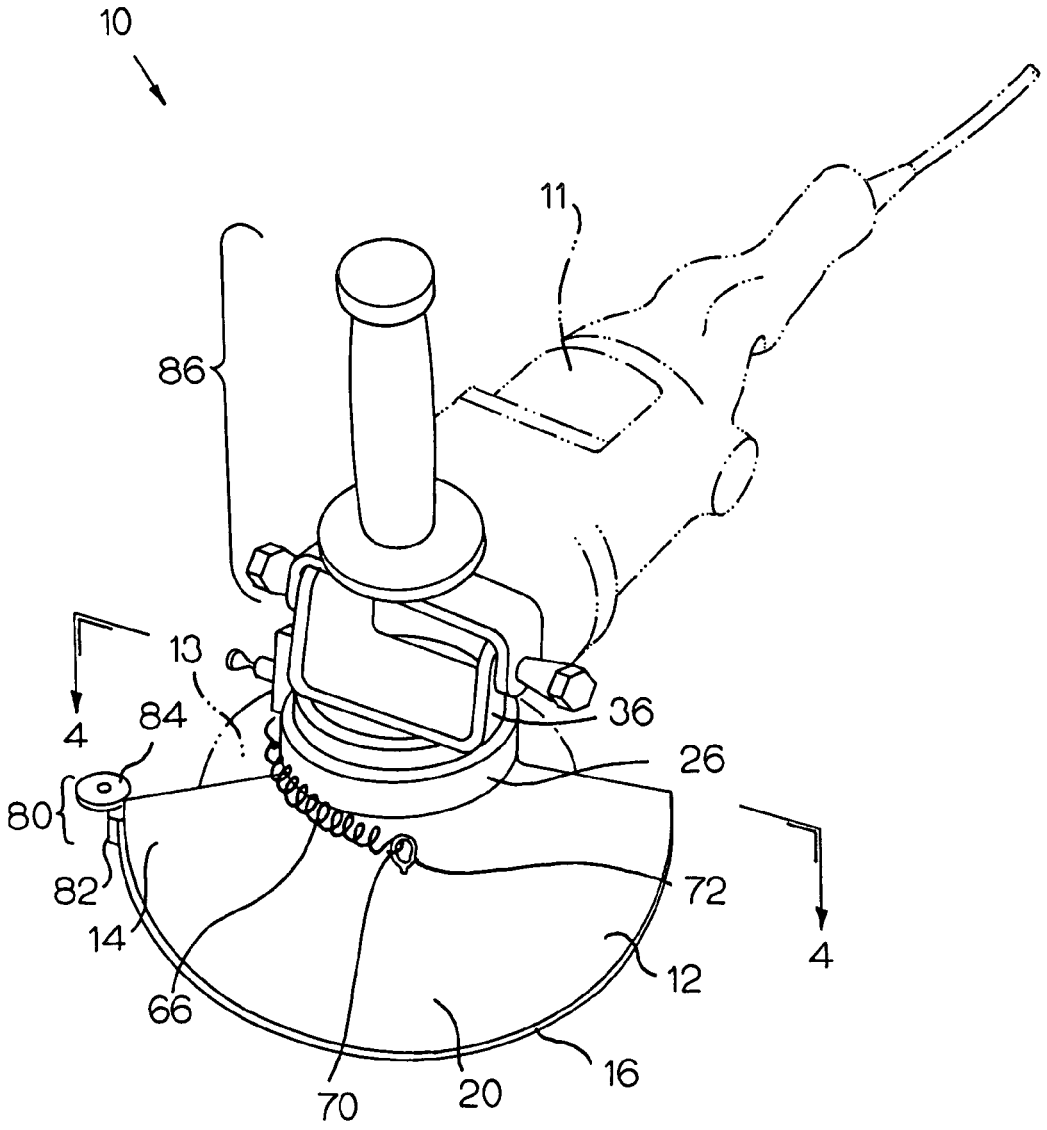
FIG. 3 is an alternate perspective view of the guard of FIG. 1.

Referring first to FIGS. 1 and 2, a preferred guard 10 made in accordance with the present invention includes a hood 12 for enclosing a portion of a cutting disc 13. The hood 12 has an upper surface 20 which is substantially semi-circular and annular in geometry, and a peripheral wall 16 secured to and extending substantially perpendicularly down from the periphery of the upper surface 20. Preferably, the hood 12 further includes a lower surface (not shown), the upper and lower surfaces being separated and joined by the peripheral wall 16 to define an interior volume adapted to enclose a portion of the cutting disc 13.

Secured to and extending from the upper surface 20 of the hood 12 is an annular engaging collar 26. This engaging collar 26 is secured to the upper surface 20 of the hood 12 such that the respective annular openings defined through the upper surface of the hood 12 and through the engaging collar 26 are in registry with one another. The engaging collar 26 itself has an inner surface 28 and an outer surface 30, the importance of which will be further described below.

Figure 5:
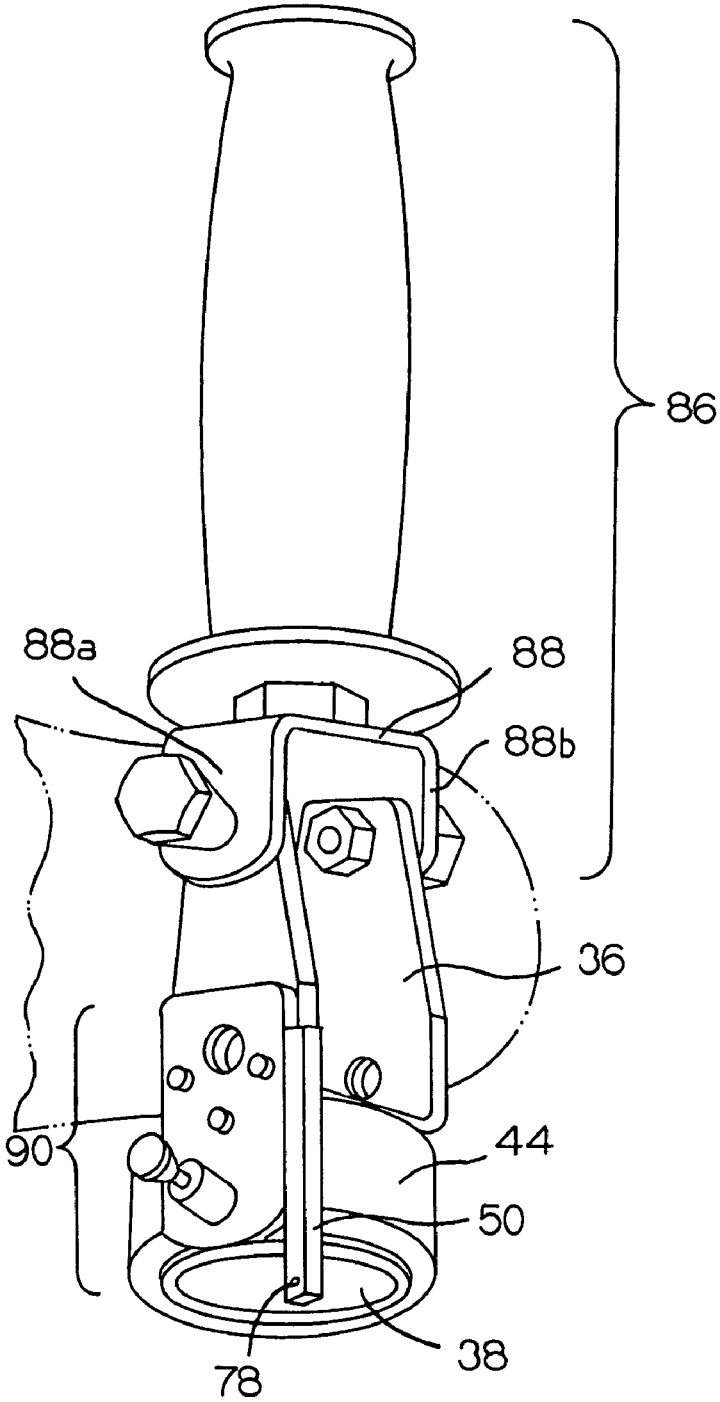
FIG. 5 is an alternative perspective view of a portion of the guard of FIG. 1, illustrating the underside of the rotating collar and bearing sleeve.

Referring now to FIGS. 1, 2, and 5, the guard 10 of the present invention further includes a bracket 36, a bearing sleeve 38 mounted to a lower surface of the bracket 36 and extending downwardly therefrom, and a collar 44 mounted to and adapted for rotation with respect to the bearing sleeve 38. Specifically, the rotating collar 44 is adapted to fit around the outer circumferential surface of the bearing sleeve 38, such that the rotating collar 44 can freely rotate on bearings (not shown) contained within the bearing sleeve 38.

As an additional refinement, it is contemplated and preferred that the useful life of the guard 10 be extended by providing a means to allow lubrication of the bearings, for example, a standard grease fitting capable of providing lubrication via a lubricating aperture. A bearing cap (not shown) may also be provided to engage and seal the respective bottom surfaces of the engaging collar 26, further reducing lubricant wastage.

The rotating collar 44 is then mated with the engaging collar 26 that is secured to the upper surface 20 of the hood 12. Specifically, the rotating collar 44 has an circumferential outer surface 52 which is dimensioned to engage the circumferential inner surface 28 of the engaging collar 26. Accordingly, the rotating collar 44 can be fit into the engaging collar 26, and then secured to the engaging collar 26 by one or more set screws (not shown) passing through threaded apertures in the engaging collar 26 and into contact with the circumferential outer surface 52 of the rotating collar 44. Thus, since the engaging collar 26 and hood 12 are secured to the rotating collar 44, the engaging collar 26 and hood 12 rotate with the rotating collar 44 relative to the bearing sleeve 38.

As best shown in FIG. 2, the bracket 36 also includes two substantially parallel and upwardly extending legs 36*a*, 36*b*. Apertures 46*a*, 46*b* are defined through the respective legs 36*a*, 36*b* to allow for mounting of the guard 10 to the cutting tool 11 though the use of bolts 48*a*, 48*b* or similar common fasteners. Also, as a further refinement, additional apertures 47*a*, 47*b* may be defined through the respective legs 36*a*, 36*b* to allow for access to the cutting disc lock on the cutting tool 11 while the guard 12 is attached to the cutting tool 11. In this regard, an engaging member (not shown) may be provided to engage the cutting disc lock, extending out of either aperture 47*a*, 47*b* to allow a user to manipulate the cutting disc lock from outside of the bracket 36.

In this preferred embodiment, the guard 10 also includes a handle assembly 86 that is attached to the bracket 36 to improve a user's grip on the cutting tool 11, thereby increasing user comfort and providing the user with better control of the cutting tool 11. In this regard, the handle assembly 86 preferably includes a bracket 88 that is designed for attachment to the bracket 36. Specifically, the bracket 88 includes a pair of downwardly extending legs 88*a*, 88*b* through which respective apertures 87*a*, 87*b* are defined. The bracket 88 can therefore be positioned with its downwardly extending legs 88*a*, 88*b* adjacent the outside surfaces of the upwardly extending legs 36*a*, 36*b* of the bracket 36, and with the apertures 87*a*, 87*b* in registry with those apertures 46*a*, 46*b* defined through the bracket. Thus, the handle assembly 86 is interposed between the bracket 36 and the bolts 48*a*, 48*b* or similar common fasteners used for mounting the guard 10 to the cutting tool 11. It is further contemplated and preferred that the handle assembly 86 may be mounted to the bracket 36 at a variety of different angles relative thereto, thereby allowing a user to orient the handle assembly 86 as he sees fit.

Referring still to FIGS. 1, 2, and 5, the guard 10 further includes at least one arm 50 secured to and extending from the bracket 36 in substantially parallel orientation with respect to the common central axis of the bearing sleeve 38 and the rotating collar 44, the importance of which is further described below.

Referring now to FIGS. 1–4, the preferred guard 10 of the present invention further includes a spring 66 for biasing a first end 14 of the hood 12 into substantially continuous contact with a workpiece (not shown) during operation of the cutting tool 11. Specifically, the biasing spring 66 preferably has a first end 68 that is secured to a distal end of the arm 50 that extends from the bracket 36, and a second end 70 that is secured to the hood 12. In this preferred embodiment, the first end 68 and the second end 70 of the spring 66 are each configured into hook shapes. Thus, the first end 68 of the spring 66 may be threaded through and secured to an aperture 78 (as best shown in FIG. 2 and FIG. 5) in the arm 50 extending from the bracket 36, and the second end 70 of the spring 66 may be secured to an eye bolt 72 affixed to the upper surface 20 of the hood 12. Of course, various means of the securing the spring 66 so as to provide the proper biasing of the hood 12 could be used without departing from the spirit and scope of the present invention. Similarly, it is contemplated that other biasing elements could be employed to provide the proper biasing of the hood 12 without departing from the spirit and scope of the present invention.

It is further preferred that the guard 10 include at least one guide mechanism 80 mounted near the first end 14 of the hood 12. Specifically, in this preferred embodiment, the guide mechanism 80 comprises: a guide arm 82 affixed to the first end 14 of the hood 12 and extending a short distance therefrom; and a guide wheel 84 rotatably mounted to a distal end of the guide arm 82. In practice, because of the biasing of the first end 14 of the hood 12, it is the guide wheel 84 that maintains substantially continuous contact with the workpiece. Because of the ability of the guide wheel 84 to rotate, there is reduced frictional contact between the guard 10 and the workpiece. Furthermore, the guide wheel 84 can aid in ensuring the proper cut during use of the cutting tool 11, as is further described below.

The preferred guard 10 of the present invention is used in the following manner. The cutting disc 13 is removed from the cutting tool, and the drive shaft of the cutting tool 11 is inserted through the bearing sleeve 38. The guard 10 is then mounted to the body of the cutting tool 11 by using bolts 48*a*, 48*b* (or similar common fasteners) which pass through apertures 46*a*, 46*b* in the bracket 36 and are then threaded into holes (not shown) in the body of the cutting tool 11. The cutting disc 13 is then reattached to the drive shaft of the cutting tool.

The first step for using the assembled guard 10 and cutting tool 11 is to identify a reference line on the workpiece corresponding to the desired cut to be made. This reference line may be scribed or drawn onto the workpiece for convenience. The cutting disc 13 (whether a disc, grinder, or brush) is then placed into contact with the workpiece, with the guide wheel 84 positioned against the reference line. Rotation of the cutting disc 13 is then initiated, and the workpiece is cut with the cutting disc 13 while tracing the predetermined reference line with guide wheel 84.

As the cutting tool 11 progresses along the circumference of the outer surface of the workpiece, the angle of the workpiece's surface may change, for example, if the workpiece is a pipe or other rounded member. Regardless of the angle of the surface being cut or the angle at which the cutting tool 11 is held while cutting the workpiece, the biasing spring 66 continually urges the hood 12 and guide wheel 84 affixed thereto into substantially continuous contact with the workpiece. The contact of the hood 12 with the surface of the workpiece thus causes the hood 12 to rotate (with the engaging collar 26 and rotating collar 44) relative to the bearing sleeve 38. As a result, the position of the hood 12 relative to the cutting disc 13 is automatically adjusted so as to continuously protect the user from accidentally contacting the disc 13. Specifically, the portion of the cutting disc 13 of the tool 11 in closest proximity to the user's body parts remains covered and enclosed within the hood 12 regardless of the angle at which the workpiece is being cut, without any need for the user to manually reposition the guard 10. Upon completion of the desired cut and removal of the tool 11 from contact with the workpiece, the biasing spring 66 returns the hood 12 to its original position.

As a further refinement, the preferred guard 10 may also include a locking device 90 that allows the user to temporarily disable the ability of the hood 12 to rotate. This feature is advantageous for users wishing to work on a particular area of a workpiece, especially those which are flat, square, or angled.

Figure 4:
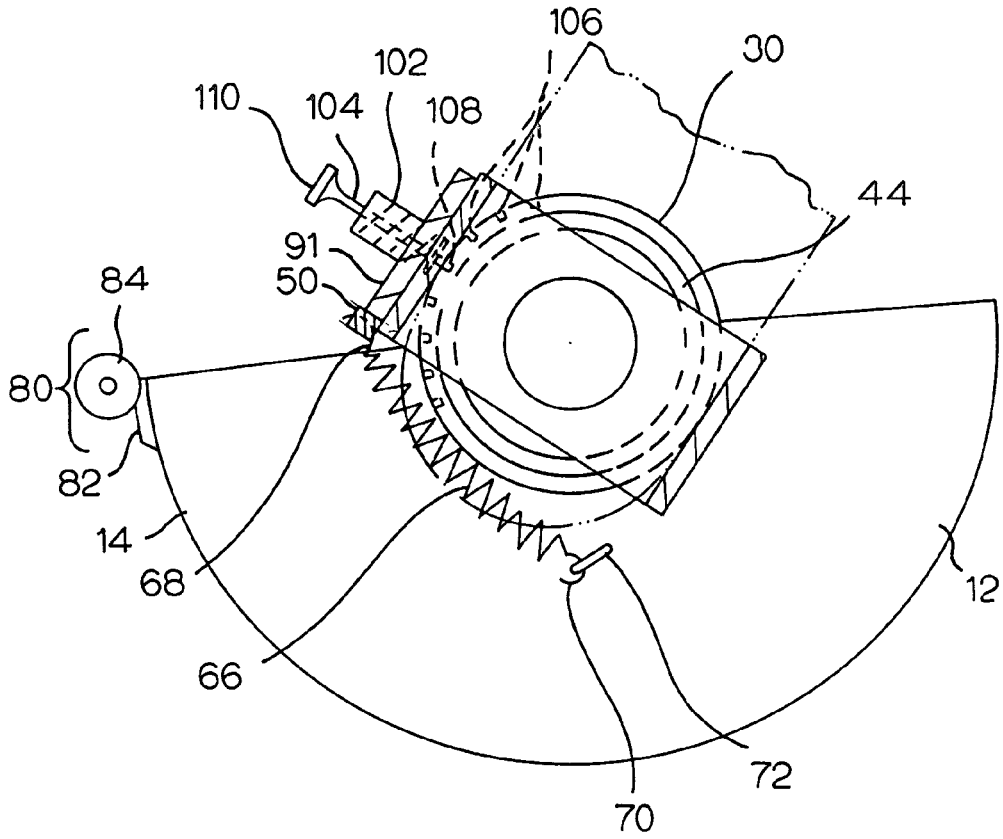
FIG. 4 is a sectional view of the guard of FIG. 1 taken along line 4—4 of FIG. 3.

The preferred locking device 90 is best described with reference to FIG. 2 and FIG. 4. The preferred locking device 90 includes a mount plate 91 having a tubular projection 102, and a spring-loaded pin 104 housed within this tubular projection 102. One leg 36*a* of the bracket 36 is provided with one or more apertures 100*a*, 100*b*, 100*c* which allow the mount plate 91 to be secured thereto using screws (or similar fasteners) 98*a*, 98*b*, 98*c*. The spring-loaded pin 104 has a first end protruding from an upper opening in the tubular projection 102 to which a knob 110 is attached (as is further described below), and a distal tip 108 which is preferably rounded and adapted to extend through a lower opening in the tubular projection 102.

A plurality of slots or indentations 106 are defined at spaced intervals along all or a portion of the circumferential surface of the engaging collar 26. Each of these slots or indentations 106 are adapted to receive the distal tip 108 of the spring-loaded pin 104. Thus, when the user wishes to lock the hood 12 into a particular position, the knob 110 may be grasped and the spring-loaded pin 104 may be pulled away from the outer surface 20 of the engaging collar 26. The engaging collar 26 and rotating collar 44 may then be rotated until the distal tip 108 of the pin 104 is aligned with a desired slot or indentation 106 in the outer surface 30 of the engaging collar 26. When the knob 110 of the pin 104 is thereafter released, the distal tip 108 of the pin 104 drops into the desired slot or indentation 106. When the distal tip 108 of the pin 104 is contained within one of the slots or indentations 106, the engaging collar 26 is essentially locked relative to the bracket 36 and bearing sleeve 38, temporarily disabling the ability of the hood 12 to rotate relative to the bearing sleeve 38.

To prevent the spring-loaded pin 104 from engaging a slot or indentation 106 in the outer surface 30 of the engaging collar 26, and thus allowing free rotation of the hood 12, it is preferred that the pin 104 is threaded substantially along its length, except for the portion that engages a slot or indentation 106. The knob 110 is provided with a threaded channel (not shown) through its center, and the knob 110 is attached to the first end of the pin 104 by threading the pin 104 into this channel. Thus, by rotating the knob 110 clockwise, the threaded pin 104 is drawn upwardly within the threaded channel defined through the knob 110, thus raising the distal tip 108 of the pin 104 into the tubular projection 102 such that it is incapable of contacting the slots or indentations 106 in the engaging collar 26.

It will be obvious to those skilled in the art that other modifications may be made to the invention as described herein without departing from the spirit and scope of the present invention.

What is claimed is:

1. A guard for a rotary cutting tool having a cutting disc for engaging a workpiece, comprising:

a bracket for mounting said guard to the rotary cutting tool;

a hood mounted to said bracket and adapted for rotation with respect to said bracket, said hood enclosing a portion of said cutting disc;

a spring having a first end that is secured to said bracket and a second end that is secured to said hood, said spring biasing a first end of said hood into substantially continuous contact with the workpiece during operation of the rotary cutting tool;

a bearing sleeve mounted to a lower surface of said bracket and extending downwardly therefrom;

a rotating collar mounted to and adapted for rotation with respect to said bearing sleeve; and an engaging collar secured to an upper surface of said hood, said rotating collar having a circumferential outer surface which is dimensioned to engage a circumferential inner surface of said engaging collar, such that said rotating collar can be fit into and secured to said engaging collar, said engaging collar and hood thus rotating with said rotating collar relative to said bearing sleeve.

2. A guard for a rotary cutting tool as recited in claim 1, wherein said rotating collar is secured to said engaging collar by one or more set screws.

3. A guard for a rotary cutting tool as recited in claim 1, and further comprising a locking device that allows for the temporary prevention of rotation of said hood relative to said bracket during operation of the rotary cutting tool.

4. A guard for a rotary cutting tool as recited in claim 3, wherein said locking device includes a spring-loaded pin adapted to selectively engage one of a plurality of slots arrayed at spaced intervals along a portion of a circumferential outer surface of said engaging collar to prevent rotation of said engaging collar and said hood relative to said bearing sleeve during operation of the rotary cutting tool.

5. A guard for a rotary cutting tool having a cutting disc for engaging a workpiece, comprising:

a bracket for mounting said guard to the rotary cutting tool, said bracket including an arm secured to and extending from said bracket;

a hood mounted to said bracket and adapted for rotation with respect to said bracket, said hood enclosing a portion of said cutting disc; and a spring having a first end that is secured to a distal end of the arm extending from said bracket and a second end that is secured to said hood, said spring biasing a first end of said hood into substantially continuous contact with the workpiece during operation of the rotary cutting tool.

6. A guard for a rotary cutting tool as recited in claim 5, wherein the second end of said spring is secured to said hood through an eye bolt affixed to an upper surface of said hood.

7. A guard for a rotary cutting tool having a cutting disc for engaging a workpiece, comprising:

a bracket for mounting said guard to the rotary cutting tool;

a hood mounted to said bracket and adapted for rotation with respect to said bracket, said hood enclosing a portion of said cutting disc;

at least one guide mechanism mounted near a first end of the hood for maintaining substantially continuous contact with the workpiece during operation of the rotary cutting tool, said guide mechanism including a guide arm affixed to said first end of the hood and extending a short distance therefrom, and a guide wheel rotatably mounted to a distal end of said guide arm; and a spring having a first end that is secured to said bracket and a second end that is secured to said hood, said spring biasing the guide mechanism into substantially continuous contact with the workpiece during operation of the rotary cutting tool.

* * * * *